US007455433B2

(12) United States Patent
Pazula et al.

(10) Patent No.: US 7,455,433 B2
(45) Date of Patent: Nov. 25, 2008

(54) LIGHT FIXTURE WITH QUICK SUPPORT ASSEMBLY

(75) Inventors: Bruce Raymond Pazula, Broadview Heights, OH (US); Kenneth J. Nicholas, Parma, OH (US)

(73) Assignee: The L.D. Kichler Co., Cleveland, OH (US)

( * ) Notice: Subject to any disclaimer, the term of this patent is extended or adjusted under 35 U.S.C. 154(b) by 233 days.

(21) Appl. No.: 11/029,954

(22) Filed: Jan. 5, 2005

(65) Prior Publication Data

US 2006/0146548 A1 Jul. 6, 2006

(51) Int. Cl.
*F23D 3/16* (2006.01)

(52) U.S. Cl. ..... 362/405; 362/406; 362/404

(58) Field of Classification Search ..... 362/405, 362/406, 404; 248/324, 343; 431/295
See application file for complete search history.

(56) References Cited

U.S. PATENT DOCUMENTS

| | | | | |
|---|---|---|---|---|
| 1,668,772 | A * | 5/1928 | Kestell | 362/405 |
| 4,107,770 | A * | 8/1978 | Weber | 362/405 |
| 6,283,619 | B1 * | 9/2001 | Pulaski et al. | 362/405 |
| 7,021,927 | B1 * | 4/2006 | Gryzlak | 431/295 |

* cited by examiner

*Primary Examiner*—Anabel M Ton
(74) *Attorney, Agent, or Firm*—Calfee, Halter & Griswold LLP

(57) ABSTRACT

A light fixture, comprising a base, a plurality of arms wherein at least one of the plurality of arms is preassembled to the base and can rotate relative to the base to reduce packaging volume and an external support abutting the plurality of arms when in an in-use configuration, wherein the support prevents inward radial movement of the plurality of arms toward a central vertical axis of the light fixture.

37 Claims, 9 Drawing Sheets

LIGHT FIXTURE WITH QUICK SUPPORT ASSEMBLY

TECHNICAL FIELD

The present invention relates generally to light fixtures. In particular, the present invention relates to so-called "knock-down" ("KD") light fixtures having at least one arm that is preassembled to a base and that can rotate relative to the base to reduce packaging volume.

BACKGROUND OF THE INVENTION

Light fixtures come in a variety of shapes and sizes. A typical light fixture may have a plurality of arms attached to and extending from a base. Manufacturers may preassemble the arms to the base prior to shipping. By doing so, manufacturers relieve the buyer and/or the installer of some of the burden of assembling the light fixture prior to installation.

Pre-assembling the light fixture, however, often results in the light fixture occupying an undesirably large amount of packaging space. To alleviate this undesirable effect, manufacturers have designed light fixtures with assembled arms that can be arranged to reduce packaging volume (see, for example, U.S. Pat. No. 6,283,619). Because the arms are arranged to reduce packaging volume, however, some portions of the light fixture may not be able to be pre-assembled. For example, light fixtures of this style may include an external support, e.g. a ring support screwed to the arms, that provides stability to the assembled fixture. Prior to use, the installer or end-user may have to install the external support, typically using attachment devices such as screws.

SUMMARY OF THE INVENTION

A light fixture is provided, comprising a base, a plurality of arms wherein at least one of the plurality of arms is preassembled to the base and can rotate relative to the base to reduce packaging volume and an external support abutting the plurality of arms when in an in-use configuration, wherein the support prevents inward radial movement of the plurality of arms toward a central vertical axis of the light fixture.

BRIEF DESCRIPTION OF THE DRAWINGS

In the accompanying drawings, which are incorporated in and constitute a part of this specification, embodiments of the invention are illustrated, which together with a general description of the invention given above, and the detailed description given below, serve to exemplify the principles of this invention, wherein.

DETAILED DESCRIPTION OF THE INVENTION

The present invention is generally directed toward a light fixture. In particular, the present invention relates to a light fixture having a plurality of arms extending from a base where at least one arm can be adjusted to reduce packaging volume. Each arm may carry a light socket or one or more other electrical connectors, which may accept one or more light bulbs or other sources of illumination.

Figure 1:
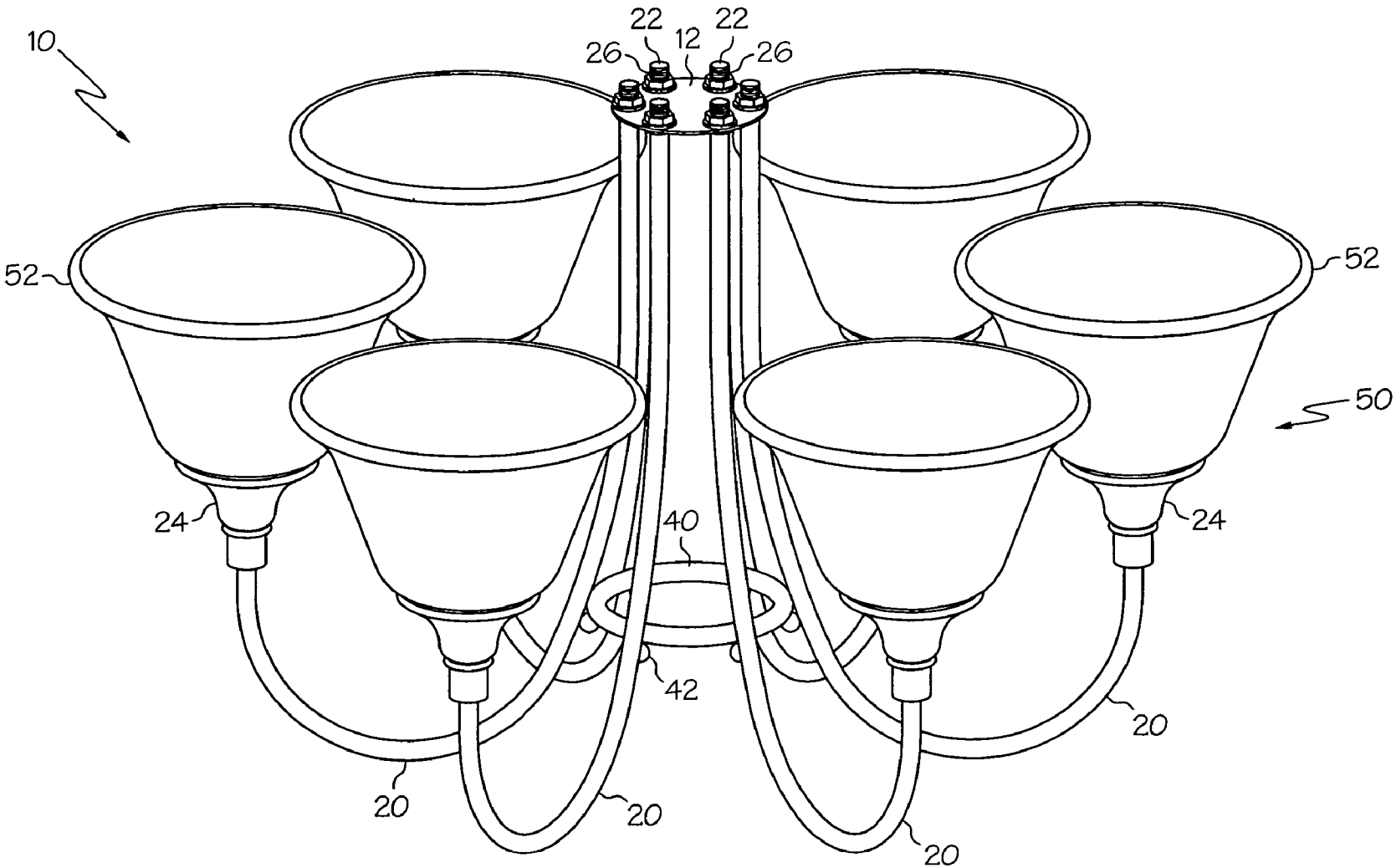
FIG. 1 is a isometric view of a first exemplary light fixture according to the present invention.
Figure 2:
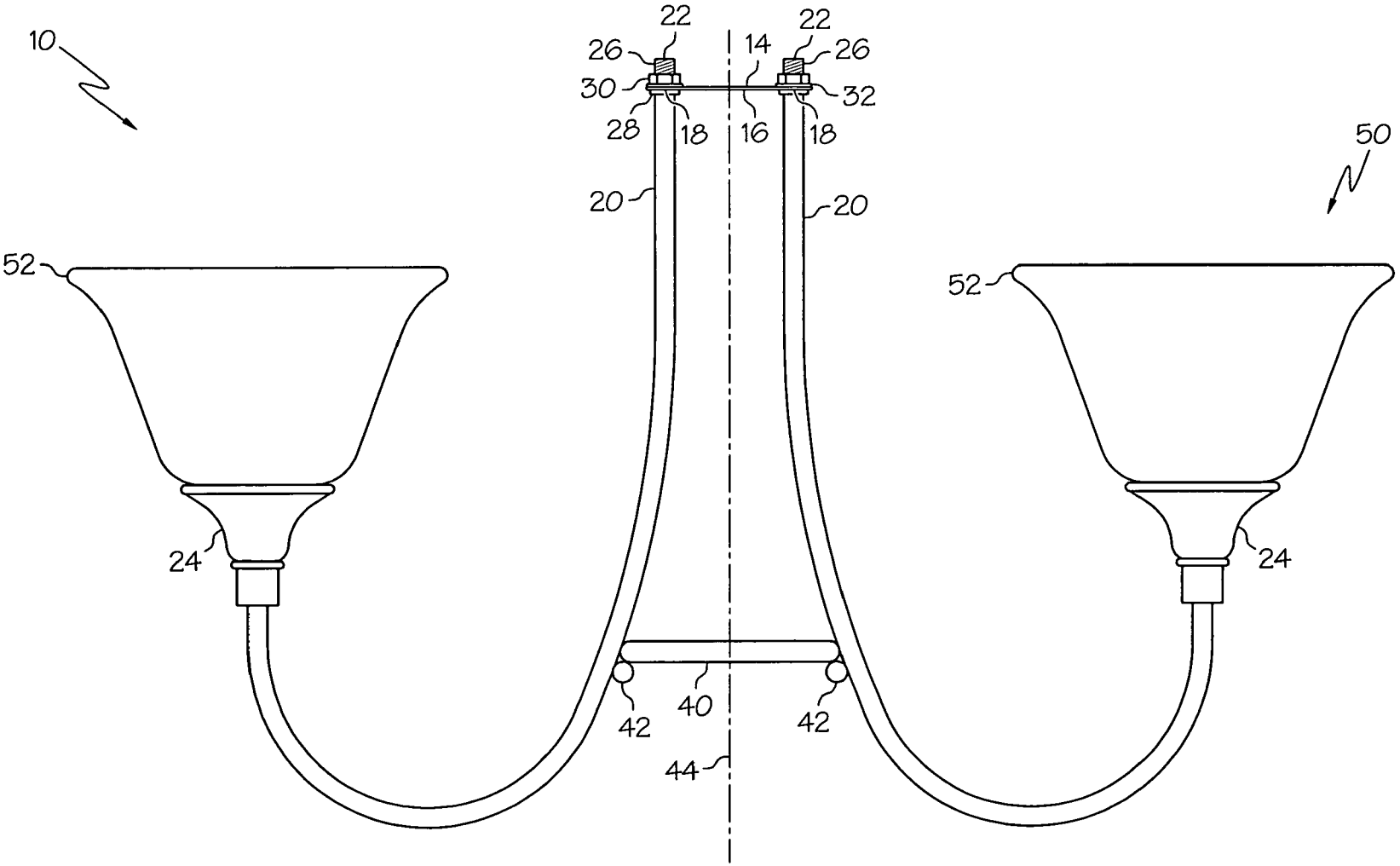
FIG. 2 is a side elevational view of the exemplary light fixture shown in FIG. 1, with several of the arms removed to more clearly show the support.

As representative of the present invention, FIGS. 1 and 2 illustrate an exemplary light fixture 10 in accordance with a first exemplary embodiment of the invention. The light fixture 10 includes a base 12 that is adapted to secure and support a plurality of arms 20 extending therefrom. For illustrative purposes, only two arms are depicted in FIGS. 2, 6A-6C, and 8. Additional arms, however, are typically employed. For example, in FIGS. 1 and 7 the light fixture 10 is depicted with six arms.

As illustrated in FIGS. 1 and 2, the base 12 may be generally planar and may include a first surface 14, a second surface 16, and a plurality of peripheral openings 18. The number of peripheral openings 18 generally corresponds to the number of arms 20 included in the light fixture 10. Each peripheral opening is adapted to receive one of the plurality of arms 20. Those skilled in the art will appreciate that the base 12 can be configured in a variety of shapes and sizes while being equally able to secure and support the plurality of arms 20 extending therefrom. The base 12 is preferably made of a material with sufficient strength to withstand the forces the arms 20 exert on the base 12 when the light fixture 10 is in-use. suitable materials for the base 12 include steel, steel alloys, bronze, brass, chrome, and other materials with sufficient strength. The base 12 may be manufactured using common manufacturing techniques known to those skilled in the art.

The exemplary light fixture 10 also includes a plurality of arms 20. The arms 20 are elongated and include a base end 22 for securing the arms 20 to the base 12 and a lamp end 24 for supporting a lamp 50. The lamp 50, typically includes a light socket 51 and may include a shade or cover 52. Electrical wiring (not shown) extends from the light socket through the arms 20 to the base 12 for electrically connecting the light socket to a power source. The arms 20 are illustrated in FIGS. 1 and 2 with an arcuate shape. Those skilled in the art, however, will appreciate that other shapes are equally suitable for the arms 20 of the light fixture 10. suitable materials for the arms 20 include steel, steel alloys, bronze, brass, chrome, and other materials with sufficient strength. The arms 20 may be manufactured using common manufacturing techniques known to those skilled in the art.

Figure 3:
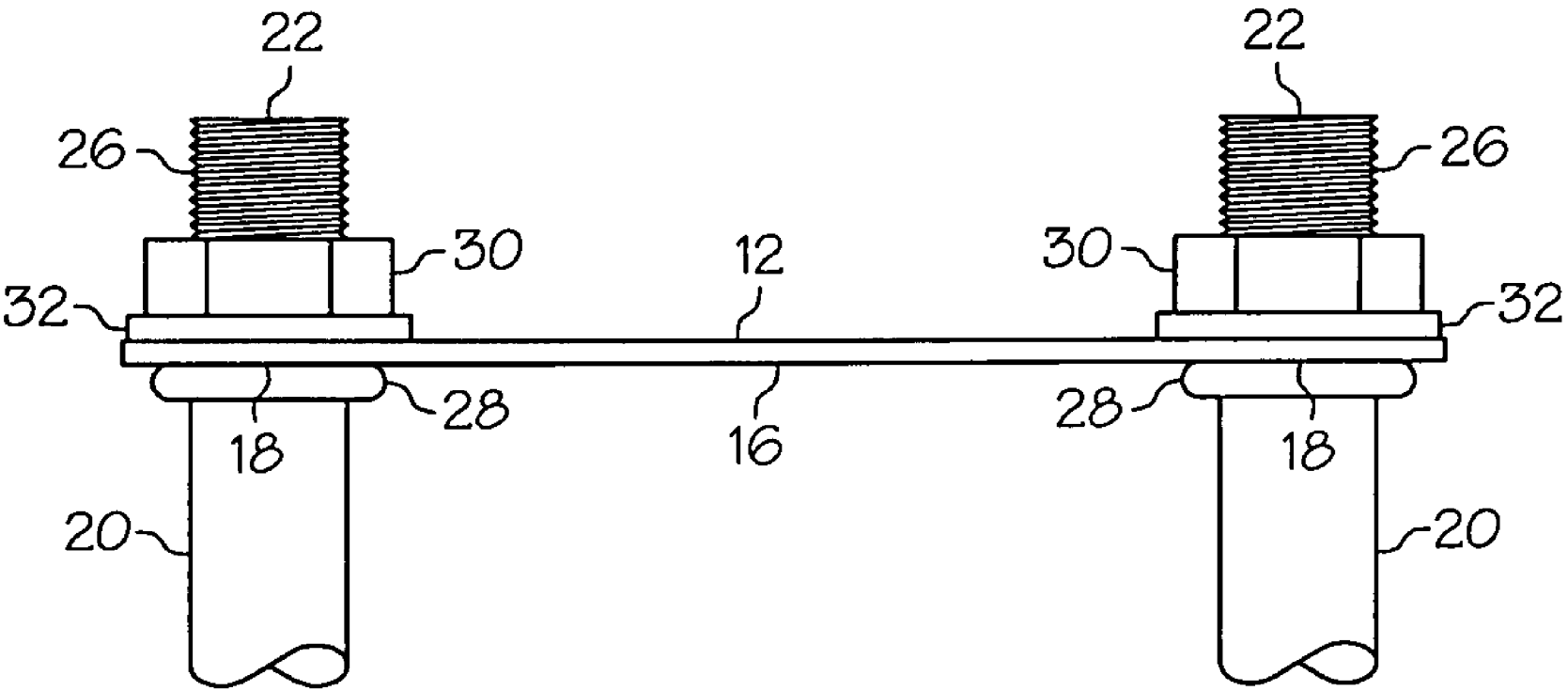
FIG. 3 is a close-up side elevational view of the base of the exemplary light fixture shown in FIG. 1.

FIG. 3 illustrates a close-up side view of the base 12 of the exemplary light fixture 10 of FIG. 1. The base end of each arm may include a threaded portion and a stop that is distal from the threaded portion. The base end 22 of each exemplary arm 20 shown in the figures includes a threaded portion 26 and a bead portion 28 that is distal from the threaded portion 26. The bead may be affixed to the arm 20. For example the bead may be rigidly affixed to the arm by any suitable method, e.g., any one or more of the following: welding, adhesives, integral molding, etc. The threaded portion 26 of each arm 20 shown extends through one of the peripheral openings 18 of the base 12 such that the bead portion 28 abuts the second surface 16 of the base 12 acting as a stop. A nut 30 and a spring washer 32 fasten each arm 20 to the base 12 preventing axial movement of each arm 20 relative to the base 12. Each arm 20, however, may still rotate relative to the base 12 if sufficient force is provided by hand or with a tool. The arms may be secured to the base by other ways and still permit the arm to rotate relative to the base, e.g., as shown in U.S. Pat. No. 6,283,619.

Figure 4:
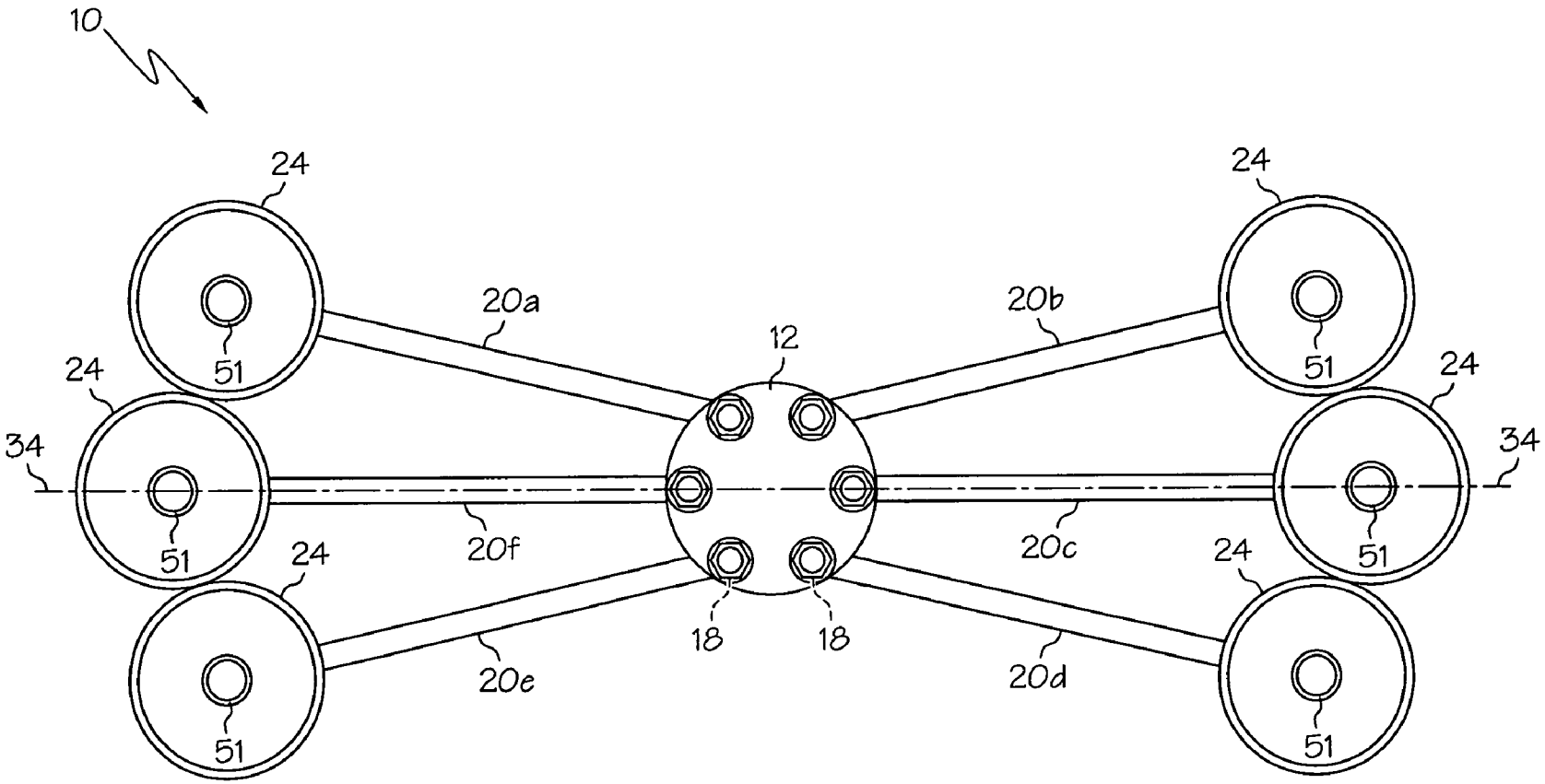
FIG. 4 is a top plan view of the exemplary light fixture shown in FIG. 1 with the shades removed and the arms in a packaging configuration.

By rotating an arm 20 relative to the base 12, the manufacturer of the light fixture 10 can reduce packaging volume of the light fixture 10 while still providing a light fixture 10 with the arms 20 preassembled to the base 12. FIG. 4 illustrates a top view of the exemplary light fixture 10 in a packaging configuration. In a packaging configuration, at least one arm 20 is rotated relative to the base 12 toward at least one axis 34 (which axis 34 may align with one or more of the arms 20). In FIG. 4, two arms 20*a*, 20*e* are rotated toward the axis 34 extending from one side of the base 12 while the two other arms 20*b*, 20*d* are rotated toward the axis 34 extending from the other side of the base 12. To further reduce packaging volume, the shade or cover 52 of the lamp 50 maybe removed for packaging (as shown in FIG. 4).

Figure 5:
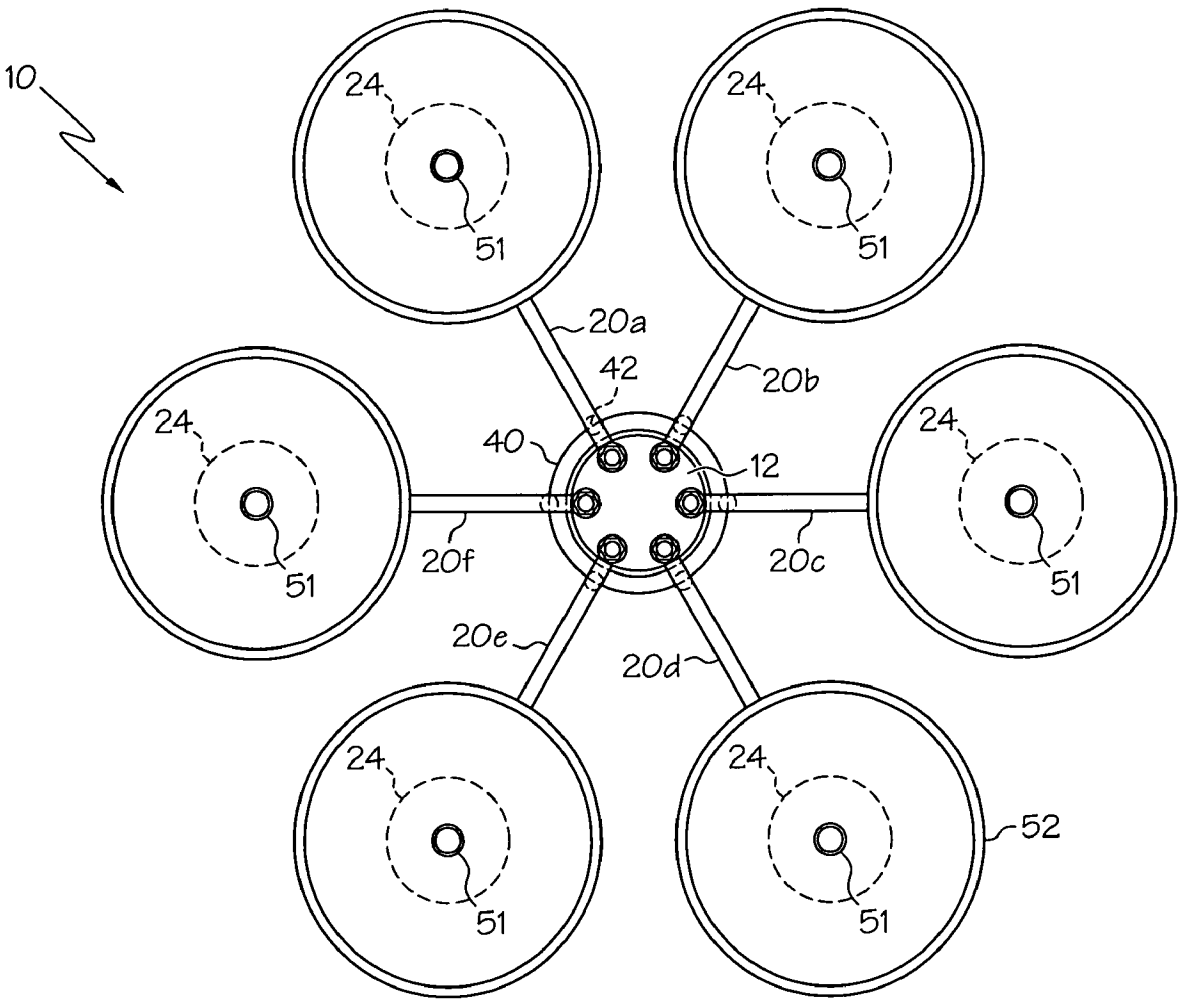
FIG. 5 is a top plan view of the exemplary light fixture shown in FIG. 1 with the arms in an in-use configuration.

FIG. 5 illustrates a top view of the exemplary light fixture 10 in an in-use configuration. From the packaging configuration (as shown in FIG. 4), the light fixture 10 may be changed to the in-use configuration by rotating two arms 20*a*, 20*e* away from the axis 34 extending from one side of the base 12 while rotating two other arms 20*b*, 20*d* away from the axis 34 extending from the other side of the base 12. In an in-use configuration, each arm 20 may rotate to a position circumferentially spaced apart from the arms adjacent to it, preferably, but not necessarily, evenly spaced. In addition, an external support 40 abuts each of the arms 20 at a point along their length. In the exemplary embodiment illustrated in FIGS. 1-6, the external support 40 is shown as being annular with a generally circular cross section and is positioned generally along a central vertical axis 44 of the light fixture 10. Each arm 20 engages an outer surface of the support 40 preventing inward radial movement of the arms 20 toward a central vertical axis 44 of the light fixture 10. The support 40, however, preferably does not use any attachment device to restrain the arms, such as screws, nuts and bolts, adhesives, clamps, or other devices. Therefore, though the support 40 prevents inward radial movement of the arms 20 toward a central vertical axis 44, the support 40 does not prevent rotation of the arms 20 relative to the base 12. Suitable materials for the support 40 include steel, steel alloys, bronze, brass, chrome, and other materials with sufficient strength. The support 40 may be manufactured using common manufacturing techniques known to those skilled in the art.

The exemplary light fixture 10 of FIGS. 1-6 also includes a projection 42 extending from each arm 20. Each projection 42 engages the support 40 and, in cooperation with the arms 20, retains the support 40 in the in-use configuration. In the exemplary embodiment shown, each projection 42 is a knurl extending toward the central vertical axis 44 of the light fixture 10. Each projection 42, however, does not need to extend from each arm 20 directly toward the central vertical axis 44. The projections 42 are configured to cooperate with the arms 20 and help retain the support 40 in the in-use configuration. In the exemplary embodiment, the support 40 is annular, and positioning the projections 42 to extend toward the central vertical axis 44 is effective to retain the support 40 in the in-use configuration. Suitable materials for the projections 42 include steel, steel alloys, bronze, brass, chrome, and other materials with sufficient strength. The projections 42 may be manufactured using common manufacturing techniques known to those skilled in the art.

In the exemplary light fixture 10 of FIGS. 1-6, the position of the arms 20 and the projections 42 in the in-use configuration define a neutral space for the support 40. The arms 20 engage the support 20 in a position that restricts the rings movement axially toward the base 12. The projections 42 engage the support 20 in a position that restricts the support 20 from moving axially away from the base 12. The support 20, therefore, is in a neutral space between the arms 20 and projections 42. One of ordinary skill in the art will appreciate that the support 40 may vary in shape and size but be equally able to prevent inward radial movement of the arms 20 toward a central vertical axis 44. For example, the support may be a circular disk or an oval disk (or some other plate) with or without notches or openings, e.g., a central opening. Likewise, depending on the shape and size of the support 40, the projections 42 can help retain the support 40 in position by extending from the arms 20 in a variety of ways. For example, the projections 42 can be a knurls or some other structure or means for retaining the support 20, e.g. clips, brackets, protuberances, etc.

Figure 6A:
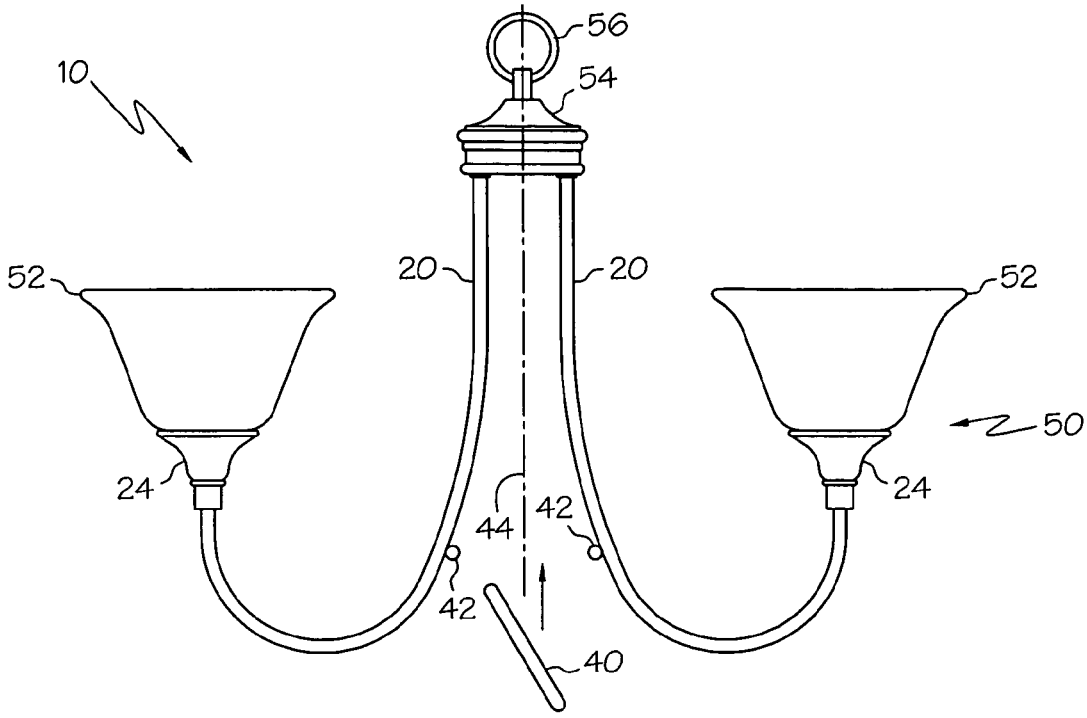
FIGS. 6A-6C are side views of the exemplary light fixture shown in FIG. 1 showing various states of installation of a support.
Figure 6B:
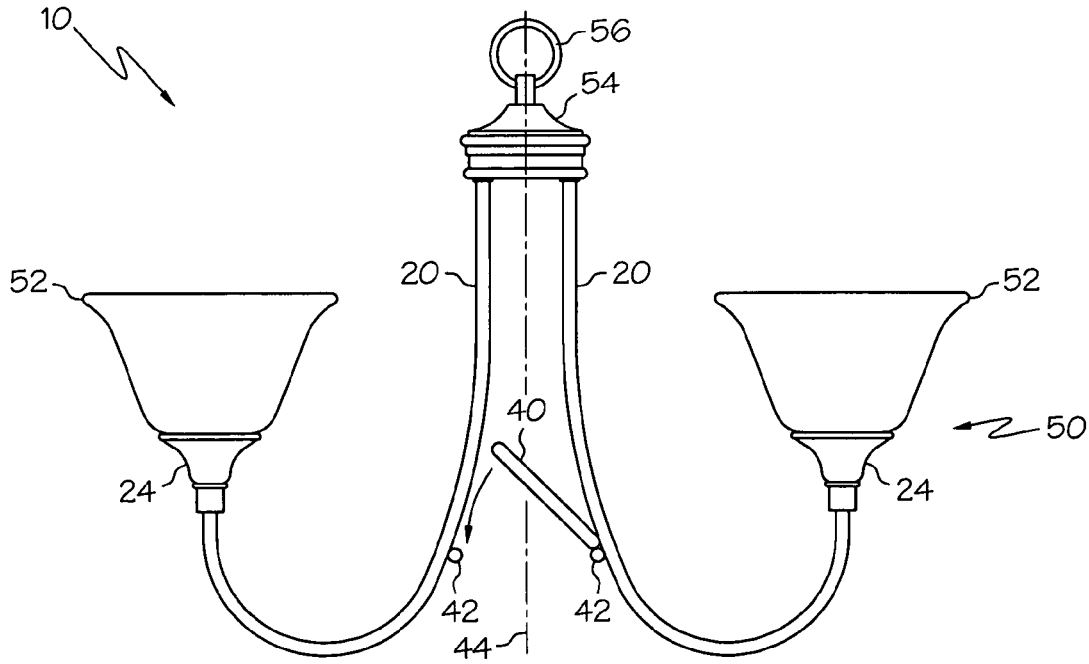
Figure 6C:
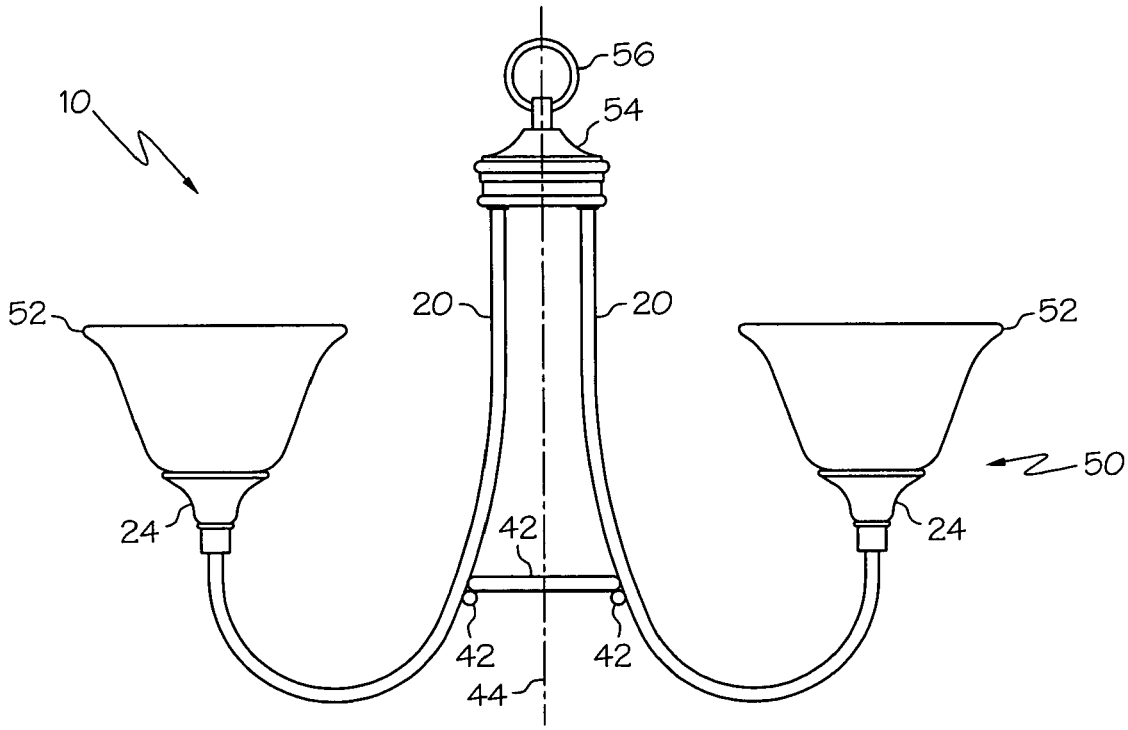

FIGS. 6A-6C illustrate various stages in a method for positioning the support 40 of the exemplary light fixture 10 of FIGS. 1-6 in the in-use configuration. The exemplary light fixture 10 shown in FIGS. 6A-6C includes a cap 54 attached to the base 12. The cap 54 may include a means for installing the light fixture 10, such as a loop 56, for use in the in-use configuration. Those skilled in the art will appreciate that other shapes and sizes are equally suitable for the cap 54.

As with FIG. 2, for illustrative purposes FIGS. 6A-6C depict two arms, though additional arms would typically be employed. Fixtures with five arms or six arms are common. The arms 20 shown in FIGS. 6A-6C are positioned on opposite sides of the central vertical axis 44 and are in the in-use configuration previously described with regard to FIG. 5. As shown in FIG. 6A, the support 40 is separate from the base 12 and the arms 20 of the light fixture 10. Alternatively, the support 40 may be connected to a portion of the light fixture 10 such as the arms 20 or the base 12. For example, an embodiment of the present invention, described below in connection with FIGS. 7 and 8, includes a support 140 connected to the base 12.

To position the support 40 into the in-use configuration, in the exemplary embodiment of FIGS. 1-5, the support 40 may be tilted and situated along the central axis 44 between the projections 42 and the base 12 (as shown in FIG. 6B). From this position, the support 40, as shown in FIGS. 6B and 6C, may be moved to engage a projection 42 and then rotated to engage the remaining projections 42 and the arms 20. In doing so, the arms 20 will spread apart slightly to accommodate the diameter of the support 40 and create the neutral space previously described. Tension in the arms 20 may, but not necessarily, result from the arms 20 spreading apart to allow the support 40 to be placed into position. The tension can help retain the support 40 in the in-use configuration.

The support 40 of the exemplary embodiment of FIGS. 1-6 can be freely removable from the light fixture 10. In the in-use configuration, the support in positioned in the neutral space between the arms 20 and the projections 42. By tilting the support 40 toward the central vertical axis 44, the arms 20 will spread apart slightly to accommodate the diameter of the support 40. Further tilting of the support 40 will allow the support 40 to be freely removed.

Figure 7:
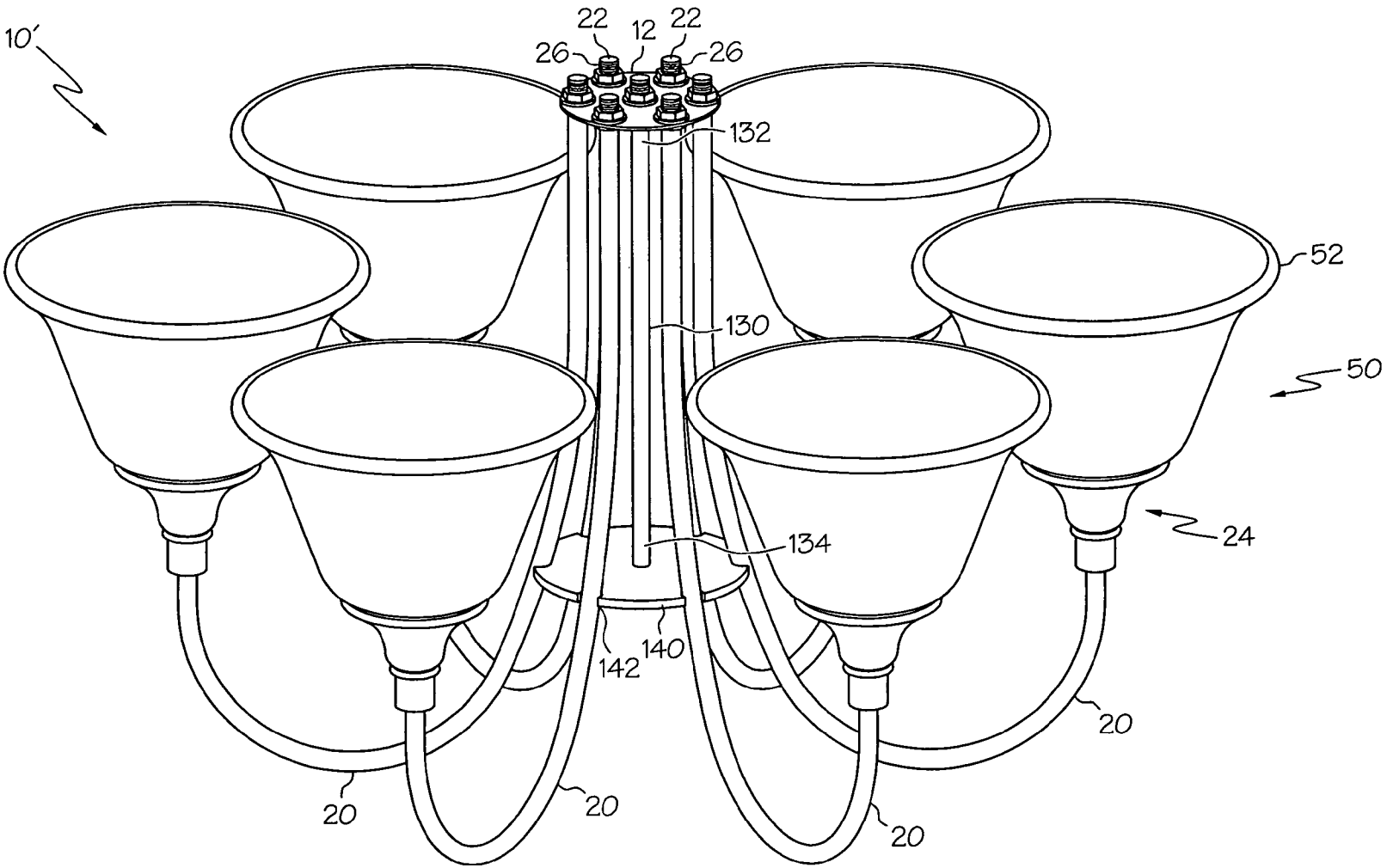
FIG. 7 is an isometric view of another exemplary light fixture according to the present invention.
Figure 8:
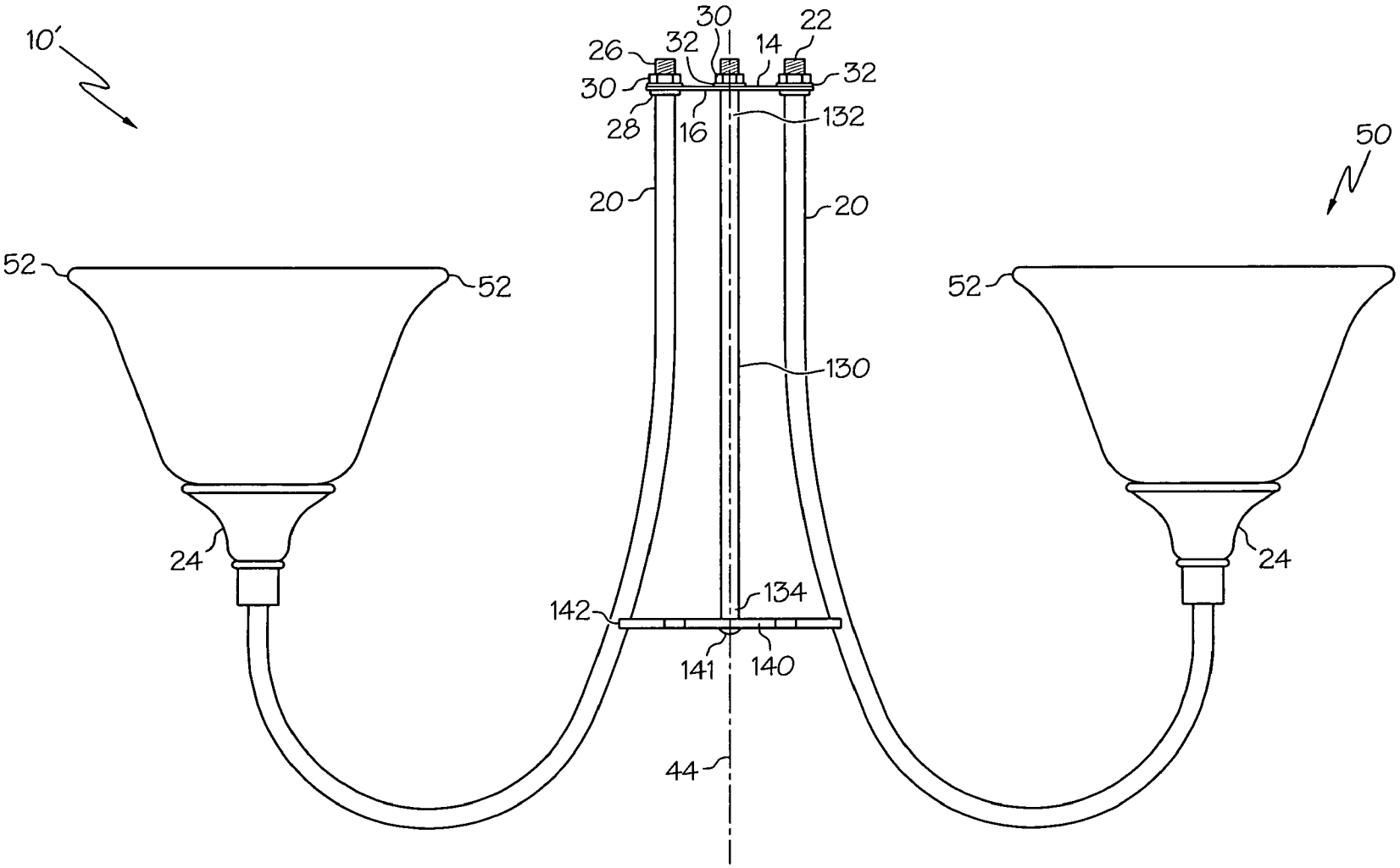
FIG. 8 is a side view of another exemplary light fixture according to the present invention.

FIGS. 7 and 8 illustrate a second exemplary light fixture 10' in accordance with a second exemplary embodiment of the present invention. Like the fixture 10 of FIGS. 1-6, the light fixture 10' of FIGS. 7-8 includes a base 12 and a plurality of arms 20 extending therefrom and, except for the particular configuration of the support 40 and projections 42, is the same as fixture 10 as discussed above. The light fixture 10' of the second exemplary embodiment also includes a link or connector 130 that is elongated and is positioned along the central vertical axis 44 of the light fixture 10'.

The connector 130 shown includes a first end 132 that attaches to the base 12 and a second end 134 that attaches to a support 140. A nut 30 and a spring washer 32 may fasten the first end 132 of the connector 130 to the base 12 in a similar manner to the nut 30 and the spring washer 32 fastening the arms 20 to the base 12 of light fixture 10, as previously described with regard to FIG. 3. In addition, a fastener, such as a screw 141, may fasten the support 140 to the second end 134 of the connector 130. Those skilled in the art, however, will appreciate that the first end 132 and the second end 134 may attach to the base 12 and the support 140, respectively, by any conventional method such as fasteners (e.g. nuts and bolts), adhesives, an interference or frictional fit, threaded engagement, or other suitable method. Suitable materials for the connector 130 and support 140 include steel, steel alloys, bronze, brass, chrome, and other materials with sufficient strength. The connector 130 and support 140 may be manufactured using common manufacturing techniques known to those skilled in the art.

The exemplary support 140 is shown as being generally planar with a generally circular cross-section and is spaced from and external to the base 12. The support 140 includes a plurality of recesses 142 along the outer edge of the support 140. Each recess 142 receives an arm 20 such that the support 140 restricts radial inward movement of the arms 20 toward a central vertical axis 44. Unlike the support 40 of FIGS. 1-6, the support 140 of FIGS. 7-8 also restricts lateral movement of the arms 20. The support 140, however, does not use a fastening device to support each arm 20; thus, the support allows rotation of each arm 20 relative to the base 12 when installed. One skilled in the art will appreciate that the connector 130 need not necessarily attach to the base and need not necessarily be positioned along the central vertical axis 44. For example, the connector may attach to an arm 20 and rotate or pivot into the in-use configuration therefrom.

While the present invention has been illustrated by the description of embodiments thereof, and while the embodiments have been described in some detail, it is not the intention of the applicant to restrict or in any way limit the scope of the appended claims to such detail. Additional advantages and modifications will readily appear to those skilled in the art. For example, the support 40 could be initially retained in place by projections 42 and then be fastened or welded in place. In addition, a light fixture 10 could employ the notched plate support 140 of FIGS. 7-8 in conjunction with the projections 42 of FIGS. 1-6 instead of (or in addition to) the connector 130. Therefore, the invention in its broader aspects is not limited to the specific details, representative apparatus and methods, and illustrative examples shown and described. Accordingly, departures may be made from such details without departing from the spirit or scope of the applicant's general inventive concept.

What is claimed is:

1. A light fixture, comprising a base;

a plurality of arms, each of the plurality of arms being configured to carry electrical wiring from the base to electrical connectors disposed on the plurality of arms, wherein at least one of the plurality of arms is preassembled to the base and is rotatable with respect to the base to reduce packaging volume; and an external support positionable in an in-use configuration to abut the plurality of arms without use of a screw attachment device to screw the external support to the arms, the support preventing inward radial movement of the plurality of arms toward a central vertical axis of the light fixture, wherein tension in the plurality of arms helps retain the external support in the in-use configuration; and wherein the support is freely removable while in the in-use configuration.

2. A light fixture according to claim 1 wherein the support while in the in-use configuration allows rotation of the at least one of the plurality of arms relative to the base.

3. A light fixture according to claim 1 wherein the support is annular.

4. A light fixture according to claim 1 wherein the support is generally planar with a generally circular cross-section; the support including a plurality of recesses along the outer edge of the support.

5. A light fixture according to claim 1 wherein a plurality of the arms are preassembled to the base and are rotatable with respect to the base to reduce packaging volume.

6. A light fixture according to claim 5 wherein the arms of at least one pair of arms positioned generally opposite from one another relative to the base are rotatable with respect to the base to reduce packaging volume.

7. A light fixture, comprising:

a base;

a plurality of arms wherein at least one of the plurality of arms is preassembled to the base and is rotatable with respect to the base to reduce packaging volume; and an external support abutting the plurality of arms when in an in-use configuration, wherein the support while in the in-use configuration prevents inward radial movement of the plurality of arms toward a central vertical axis of the light fixture while allowing rotation of the at least one of the plurality of arms relative to the base and independent of the others of the plurality of arms; and wherein tension in the plurality of arms helps retain the support in the in-use configuration, the support being freely removable while in the in-use configuration.

8. A light fixture according to clam 7 wherein the support does not use an attachment device for abutting the plurality of arms.

9. A light fixture according to claim 7 wherein the support is annular.

10. A light fixture according to claim 7 wherein the support is generally planar with a generally circular cross-section; the support including a plurality of recesses along the outer edge of the support.

11. A light fixture according to claim 7 wherein a plurality of the arms are preassembled to the base and are rotatable with respect to the base to reduce packaging volume.

12. A light fixture according to claim 11 wherein the arms of at least one pair of arms positioned generally opposite from one another relative to the base are rotatable with respect to the base to reduce packaging volume.

13. A light fixture, comprising:

a base;

a plurality of arms wherein at least one of the plurality of arms is preassembled to the base and is rotatable with respect to the base to reduce packaging volume;

a light socket disposed on at least one of the plurality of arms;

a projection extending outward from at least one of the plurality of arms; and an external support abutting at least two of the plurality of arms and projections wherein the plurality of arms and projections cooperate to retain the support in an in-use configuration;

the support preventing inward radial movement of the plurality of arms toward a central vertical axis of the light fixture.

14. A light fixture according to claim 13 wherein the support does not use an attachment device.

15. A light fixture according to claim 13 wherein the support is annular.

16. A light fixture according to claim 13 wherein the support is generally planar with a generally circular cross-section; the support including a plurality of recesses along the outer edge of the support.

17. A light fixture according to claim 13 wherein a plurality of the arms are preassembled to the base and are rotatable with respect to the base to reduce packaging volume.

18. A light fixture according to claim 17 wherein arms positioned generally opposite from one another relative to the base are rotatable with respect to the base to reduce packaging volume.

19. A light fixture according to claim 13 wherein tension in the arms helps retain the support in the in-use configuration.

20. A light fixture according to claim 13 where the support is freely removable while in the in-use configuration.

21. A light fixture, comprising:

a base;

a plurality of arms wherein at least one of the plurality of arms is preassembled to the base and is rotatable with respect to the base to reduce packaging volume;

a connector extending externally from the base along a central vertical axis of the light fixture; and an external support attached to the connector and spaced from and external to the base, the support including a plurality of recesses, where at least of the plurality of recesses is adapted to receive one of the plurality of arms, the support preventing inward radial movement of the plurality of arms toward a central vertical axis of the light fixture.

22. A light fixture according to clam 21 wherein the support does not use an attachment device.

23. A light fixture according to claim 21 wherein a plurality of the arms are preassembled to the base and are rotatable with respect to the base to reduce packaging volume.

24. A light fixture according to claim 23 wherein arms positioned generally opposite from one another relative to the base are rotatable with respect to the base to reduce packaging volume.

25. A light fixture, comprising:

a base having a plurality of peripheral openings;

a plurality of arms, wherein at least one of the plurality of arms is preassembled to the base and can be adjustably positioned to reduce packaging volume, wherein one end of each of the plurality of arms extends through one of the plurality of peripheral openings and is secured to the base;

a projection extending outward from each of the plurality of arms; and an external support abutting the plurality of arms and projections without use of an attachment device when the external support is in an in-use configuration; and wherein the projections, in cooperation with the plurality of arms, retain the external support in the in-use configuration.

26. A light fixture according to claim 25 wherein the support is annular.

27. A light fixture according to claim 25 wherein the support is generally planar with a generally circular cross-section; the support including a plurality of recesses along the outer edge of the support.

28. A light fixture according to claim 25 wherein a plurality of the arms are preassembled to the base and are rotatable with respect to the base to reduce packaging volume.

29. A light fixture according to claim 28 wherein arms positioned generally opposite from one another relative to the base are rotatable with respect to the base to reduce packaging volume.

30. A light fixture according to claim 25 wherein tension in the arms helps retain the support in the in-use configuration.

31. A light fixture according to claim 25 where the support is freely removable while in the in-use configuration.

32. A light fixture, comprising:

a base having a plurality of peripheral openings and a central opening;

a plurality of arms, wherein at least one of the plurality of arms is preassembled to the base and can be adjustably positioned to reduce packaging volume, wherein one end of each of the plurality of arms extends through a peripheral opening and is secured to the base;

a connector having a first end and second end, wherein the first end extends through the central opening and is secured to the base; and an external support affixed to the second end of the connector, such that the support is positioned to abut the plurality of arms without use of an attachment device when the support is in an in-use configuration.

33. A light fixture according to claim 32 wherein a plurality of the arms are preassembled to the base and are rotatable with respect to the base to reduce packaging volume.

34. A light fixture according to claim 33 wherein arms positioned generally opposite from one another relative to the base are rotatable with respect to the base to reduce packaging volume.

35. A light fixture according to claim 32 where the support is freely removable while in the in-use configuration.

36. A light fixture according to claim 7 wherein each of the plurality of arms is configured to carry electrical wiring from the base to electrical connectors disposed on the plurality of arms.

37. A light fixture according to claim 7 further comprising a light socket disposed on at least one of the plurality of arms.

* * * * *